United States Patent [19]

Webb

[11] Patent Number: 4,475,768

[45] Date of Patent: Oct. 9, 1984

[54] SEAT MEMBER WITH EXCHANGEABLE COVER

[75] Inventor: Ronald C. Webb, Red Lion, Pa.

[73] Assignee: Dentsply Research & Development Corp., Milford, Del.

[21] Appl. No.: 392,403

[22] Filed: Jun. 25, 1982

[51] Int. Cl.[3] ..... A47C 27/00

[52] U.S. Cl. ..... 297/283; 5/470; 297/219; 297/223

[58] Field of Search ..... 297/383, 218, 219, 220, 297/223, 283; 5/470, 471

[56] References Cited

U.S. PATENT DOCUMENTS

| | | | |
|---|---|---|---|
| 2,161,448 | 6/1939 | Bishop | 297/219 |
| 2,191,848 | 2/1940 | Cramer et al. | 297/219 X |
| 2,192,070 | 2/1940 | Cramer et al. | 297/219 |
| 3,220,767 | 11/1976 | Hendrickson | 297/219 |
| 3,248,147 | 4/1966 | Testa | 297/218 |
| 3,519,308 | 7/1970 | Kasman et al. | 297/218 |
| 3,603,639 | 9/1971 | Wilson | 297/219 |
| 3,722,950 | 3/1973 | Harnick | 297/218 |

FOREIGN PATENT DOCUMENTS

| | | | |
|---|---|---|---|
| 2435245 | 5/1980 | France | 5/470 |
| 950122 | 2/1964 | United Kingdom | 297/218 |

*Primary Examiner*—James T. McCall

*Attorney, Agent, or Firm*—C. Hercus Just

[57] ABSTRACT

A seat member to support a human body and having upper and lower planar surfaces spaced apart and connected by a continuous sidewall extending perpendicularly between and connected to the peripheries of said surfaces, and a plurality of similar covers respectively of different colors and/or textures are provided for selection of one to be attached to the seat member to provide a desired outer finished surface on said seat member. The covers have an upper and side panels complementary to the top surface and sidewall of the seat member to conform closely thereto and a bottom panel on said covers is formed to provide a plurality of attaching fingers to overlie the lower surface of the seat member. The fingers are attached to the lower surface of the seat member by strips of VELCRO or the like to maintain the selected cover upon the seat member.

2 Claims, 3 Drawing Figures

SEAT MEMBER WITH EXCHANGEABLE COVER

BACKGROUND OF THE INVENTION

The present invention pertains to a seat member such as included in chairs, stools and the like and provided with an exchangeable cover selected from a supply of similar covers of different colors and/or textures of material. It is intended that the seat member be a desired shape and size and adapted to receive an exchangeable cover of a selected color and/or texture of material for purposes of minimizing inventory of a manufacturer or distributor of finished seats, whether included in chairs, stools or otherwise.

Particularly in regard to furnishing offices, operatories, laboratories and the like, it is current practice at present to give consideration to the aesthetic aspects of the same by selecting attractive colors and/or textures of upholstery material provided particularly on chairs, stools, and the like employed in such offices, waiting rooms, operatories and laboratories. By providing a range of different colors and textures of upholstery material fixed to the seats, a relatively extensive inventory of the same must be maintained either by the manufacturer or distributor to provide a range of colors and textures from which a selection of seats may be made by a purchaser. In an effort to minimize such inventories, especially in view of the expense of providing completely finished chairs, stools and the like, the present invention has been developed for the purpose of providing a standard or basic seat member of desired shape and size and upon which a cover of desired color and/or texture of material may be mounted and securely attached to the basic seat member. By providing exchangeable covers of desired color, texture of material and the like, the only range of inventory items is in relation to the exchangeable covers, which is relatively minimal compared to the cost of entire chairs, stools or otherwise.

Basically, it is old to provide seats of different kinds with a cover of some sort to be mounted upon the seat. For example, the following patents illustrate typical examples of what has been done heretofore:

U.S. Pat. No. 2,161,448—Bishop, June 6, 1939

U.S. Pat. No. 2,191,848—Cramer et al, Feb. 27, 1940

U.S. Pat. No. 2,192,070—Cramer et al, Feb 27, 1940

For purposes of illustrating other methods of attaching seat cushions and/or covers to a basic seat member, the following patents illustrate examples of such attaching means:

U.S. Pat. No. 3,220,767—Hendrickson, Nov. 30, 1965

U.S. Pat. No. 3,603,639—Wilson, Sept. 10, 1971

The present invention provides improvements over the structures shown in the foregoing patents and the advantages thereof are set forth below, together with details of the structure.

SUMMARY OF THE INVENTION

It is among the principal objects of the present invention to provide exchangeable covers for a basic seat member of desired shape and size which is quickly adapted to have mounted thereon a selected cover of desired color, pattern and/or material texture which very closely conforms to the shape of the seat member and is provided with attaching means which are quickly detachable and attachable to securely position the cover upon the seat member in a manner to prevent any appreciable relative movement between the cover and seat member, as well as facilitate the mounting of the cover upon the seat member.

Another object of the invention ancillary to the foregoing object is to form the exchangeable cover with a top and a side panel perpendicular to the top panel and respectively similar to the top and side surfaces of the seat member, and the attaching means comprising part of a bottom panel having a periphery connected to the lower edge of the side panel, and the bottom panel being formed with a plurality of circumferentially spaced fingers or tongues extending radially from the rim of the periphery of the side panel toward the center of the lower surface of the seat member in a manner not only to secure the fingers or tongues to the lower surface of the seat member but particularly to stabilize the entire cover with respect to the seat member, thereby to minimize or prevent relative movement between the cover and seat member.

A further object of the invention is to form the aforementioned bottom panel of the cover with cutout portions somewhat resembling a cloverleaf configuration and thereby provide said aforementioned fingers or tongues, while retaining the position-maintaining function of the bottom panel of the cover, due to its engagement with the lower surface of the seat member in closely conforming relationship, the cutout proportion of the bottom panel also facilitating the mounting of the cover upon the seat member.

Still another object of the invention is to employ quickly detachable coengageable means respectively on the fingers or tongues of the bottom panel of the cover and the lower surface of the seat member in the form of non-adhesive mating strips having cooperating surfaces respectively provided with releasable interconnecting portions, one commercial version of which is sold under the tradename VELCRO.

Details of the foregoing objects and of the invention, as well as other objects thereof, are set forth in the following specification and illustrated in the accompanying drawings comprising a part thereof.

DETAILED DESCRIPTION OF THE PREFERRED EMBODIMENT

Figure 1:
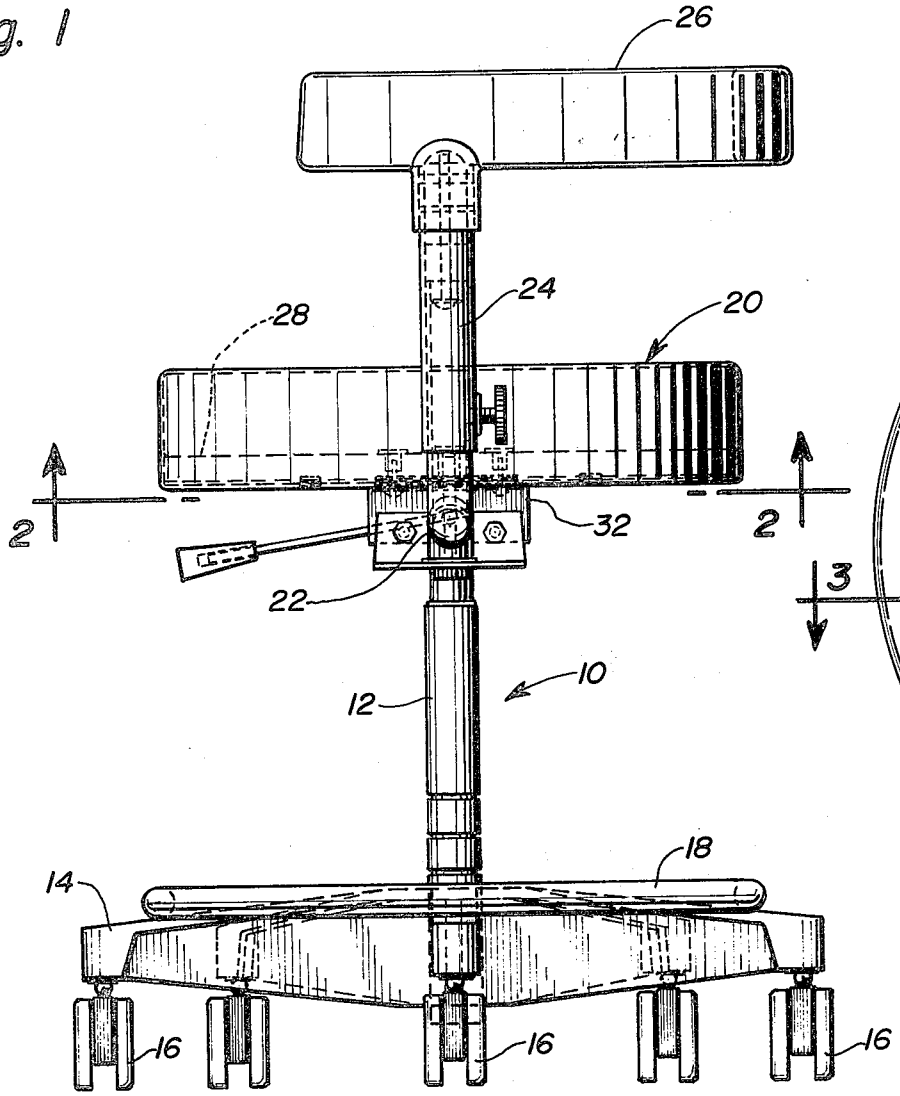
FIG. 1 is a side elevation of a typical, exemplary stool or chair having a seat member upon which an exchangeable cover has been mounted in accordance with the present invention.

It is to be understood that the present invention is applicable to a relatively wide variety of seats, among which are many types of stools, such as those used by dentists, draftsmen, beauty operators and stools for various other purposes. In addition, the invention is applicable to chairs, particularly chairs of institutional type, such as those used in restaurants, waiting rooms, and many other types of chairs, particularly where the shape and size of the seats is of uniform type and to which exchangeable covers quickly may be applied to complete the chair or stool in finished condition, ready for sale and use. Hence, while the illustration in the drawings comprises a stool of the type having casters, it is to be understood that the invention is not to be restricted to this particular type of chair seat as embodied in said stool. Referring to FIG. 1, the stool 10 illustrated therein is exemplary of one form of seat to which the invention is applicable and, specifically, comprises a stool such as used in medical fields, including dentistry. It consists of a vertical post or standard 12, which extends upward from a conventional spider-like base 14 comprising a plurality of radially extending legs upon which casters 16 are mounted and a ring 18 is also supported on the base 14 as a footrest. A seat member 20 is suitably connected to the upper end of the post or standard 12. The particular stool shown in FIG. 1 also includes a laterally extending arm 22 from the outer end of which a vertical post 24 extends for purposes of supporting on the upper end thereof a back or rest member 26, one type of which is popular on dental stools.

Figure 2:
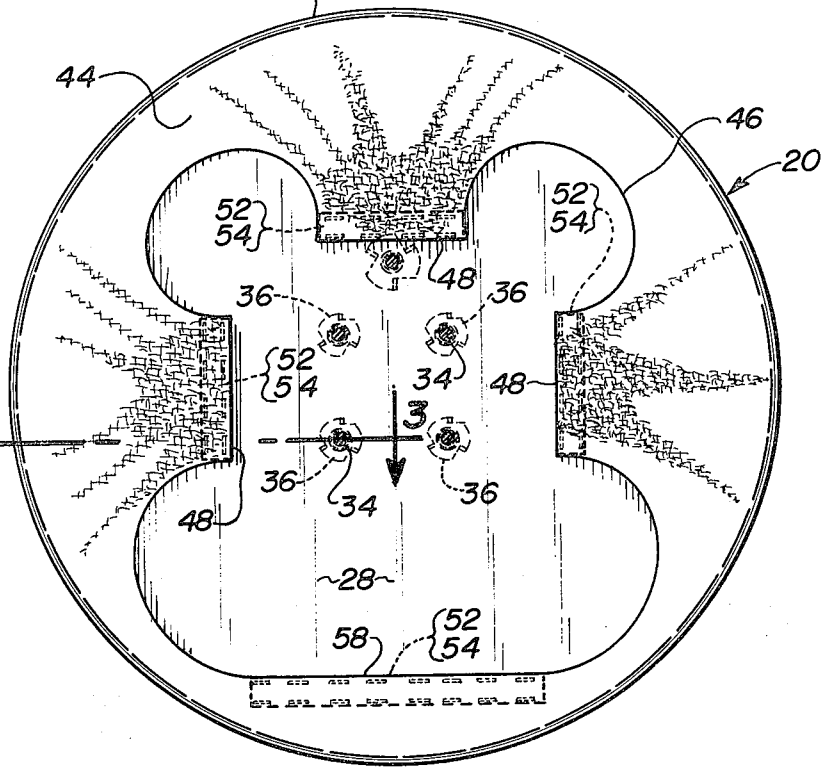
FIG. 2 is a bottom plan view of the underside of the seat shown in FIG. 1, as seen on the line 2—2 thereof and illustrating, in particular, the means by which the cover is attached to the seat member, the scale of FIG. 2 being slightly larger than that of FIG. 1.
Figure 3:
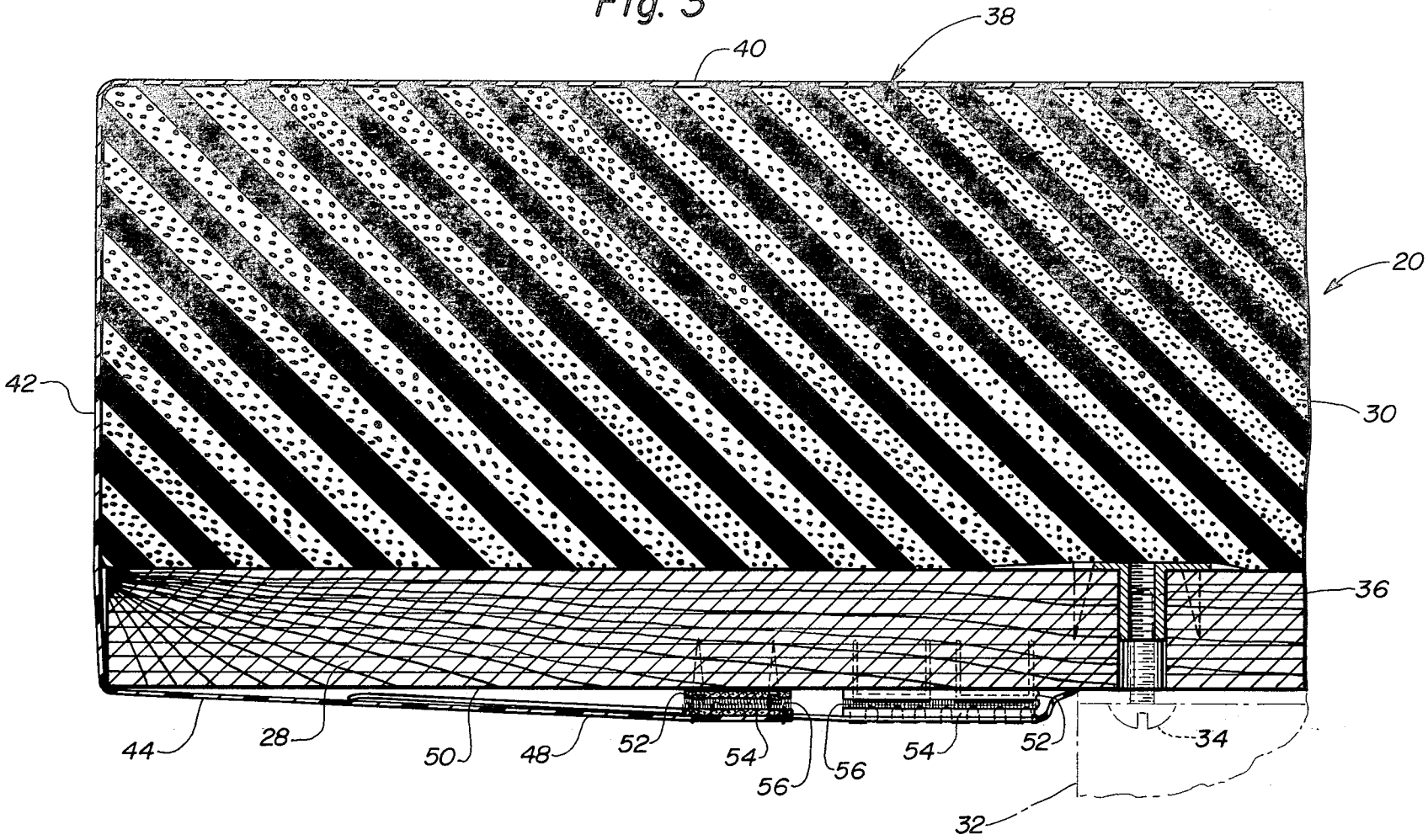
FIG. 3 is a fragmentary vertical sectional view taken on the line 3—3 of FIG. 2 and illustrating in a still larger scale details of the exchangeable cover of the invention and the means by which it is attached to the seat member.

The present invention primarily concerns the seat member 20, details of which are best shown in FIGS. 2 and 3. For purposes of economy and manufacture, the basic seat member comprises a base panel 28 formed from appropriate material, such as plywood of suitable thickness, the plan view of which determines the shape of the seat member. Suitable cushion material, such as a shaped block of foam rubber 30 or the like is connected to the upper surface of the base panel 28 by cement or otherwise. One effective and relatively inexpensive manner of connecting the base panel 28 to the upper end of post or standard 12 is to utilize a bracket 32, shown in FIG. 1, having a horizontal upper panel having holes formed therein to receive screws or bolts 34 which are threaded into commercial types of self-attaching nuts 36, details of which are best shown in FIG. 3.

In accordance with the preferred embodiment of the invention, the seat member 20, in its basic form, comprises the base panel 28 and the shaped block of cushion material 30. If desired, the seat, which normally is attached to supporting structure, such as that shown in FIG. 1, is furnished to the distributor or, if desired, one type of cover 38, formed of appropriate fabric or other flexible type of sheet material, may be furnished to the distributor, especially if it is desired to have the stool or seat leave the factory in a somewhat finished condition and appearance.

In accordance with the present invention, however, it is preferred that the distributor be supplied with a plurality of covers manufactured from a range of fabrics or flexible sheet material of different colors and/or texture from which a customer may select a desired color or texture of cover and the same then is quickly mounted upon the seat member 20 to enclose the shaped block of cushion material 30 and also cover or enclose the periphery of the base panel 28. Accordingly, the cover 38 comprises a top panel 40 having the same shape and size as the upper surface of the shaped block of cushion material 30, the periphery of the top panel 40 being secured to the upper edge of a side panel 42, which extends around the sidewall of the cushion material 30, as well as the periphery of the base panel 28.

The cover 38 also includes a bottom panel 44, the periphery of which is securely fastened to the lower edge of the side panel 42 and is formed with a cutout portion or pattern 46 somewhat resembling at least a partial cloverleaf configuration. and the edges of which do not extend to the sidewall of the cover, as shown in FIG. 2, thereby forming a plurality of fingers or tongues 48 which comprise attaching members by which the cover 38 is secured to the seat member 20 which function to stabilize the position of the cover on the seat member. The configuration of the cutout portion 46 also is such that it readily enables the cover to be extended over the seat member in a manner so that the top panel 40 thereof closely conforms to the upper surface of the cushion member 30, the side panel 42 closely conforms to and encloses the periphery of the cushion member 30, as well as the periphery of the base panel 28, and the bottom panel 44 extends across the lower surface 50 of the base panel 28.

The top and side panels 40 and 42 and bottom panel 44 may be formed of flexible sheet-like material of a wide range of types and secured together by appropriate means, including stitching of suitable strength.

Particularly in order that the cover 38 may be attached to the seat member 20 without the necessity of using tools or anything other than human hands, the invention preferably includes quickly detachable and attachable coengaging means in the form of strips 52 and 54, having cooperating surfaces respectively provided with releasable interconnecting portions 56. One highly suitable type of such strips of material is sold under the trade name VELCRO. For example, the strips 52 of such material which are secured to the lower surface 50 of the base panel 28 may be glued or stapled to said lower surface, as illustrated in exemplary manner in FIG. 3. The strips 54 may be secured to the fingers or tongues 48, as well as to the edge portion 58 of bottom panel 44, see FIG. 2, by any appropriate means, such as cement, stitching or otherwise.

From the foregoing, it will be seen that the present invention provides a seat construction for stools, chairs, and the like, to which exchangeable covers of desired color and/or texture and pattern may quickly be attached in a manner to minimize inventory of a distributor or store while providing a customer with a product having a color or texture on the seat selected by the customer.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A seat member to support a human body and having substantially planar upper and lower surfaces of similar shape spaced apart a predetermined distance, and a continuous sidewall extending substantially perpendicularly between the perimeters of said upper and lower surfaces of said seat member, in combination with a plurality of similar covers respectively of different colors and/or texture from which a selection may be made to provide a desired texture and/or color for the outer surface of said seat member, said covers comprising a top and side panel similar in shape respectively to the upper surface and sidewall of said seat member and closely conforming thereto when mounted thereupon, a planar bottom panel of pliable sheet material and similar peripheral shape as said top panel and the periphery thereof being fixedly connected to the lower edge of said side panel of said cover, said bottom panel being formed with a plurality of connected openings generally in partial cloverleaf configuration and all edges of said openings being spaced from the periphery of said bottom panel to facilitate extending the cover over said seat member when mounting said cover thereto, said openings being shaped to define a plurality of circumferentially spaced fingers extending radially inward from the periphery of said bottom panel toward the center of and parallel to said lower surface of said seat member, and quickly detachable coengageable means being secured respectively to the innermost ends of said fingers of said bottom panel of said cover and the lower surface of said seat member and operable to secure a selected cover to said seat member in a manner to prevent any appreciable movement of said cover relative to said seat member.

2. The seat member according to claim 1 in which said quickly detachable coengageable means on said fingers comprise non-adhesive mating strips having cooperating surfaces respectively provided with releasable interconnecting portions.

* * * * *